United States Patent [19]

Wagner et al.

[11] Patent Number: 4,921,031

[45] Date of Patent: May 1, 1990

[54] DECORATIVE VALANCE

[75] Inventors: John S. Wagner, Madison; John E. Morris, Lake Mills, both of Wis.

[73] Assignee: Graber Industries, Inc., Middleton, Wis.

[21] Appl. No.: 358,940

[22] Filed: May 30, 1989

[51] Int. Cl.[5] ..... E06B 9/38

[52] U.S. Cl. ..... 160/38; 160/178.1; 160/902

[58] Field of Search ..... 160/38, 39, 19, 168.1, 160/176.1, 178.1, 345, 172, 902; 5/493; 16/87.4 R, 94 R, 96 R, 95 R; 52/74, 75, 76

[56] References Cited

U.S. PATENT DOCUMENTS

| | | | |
|---|---|---|---|
| 2,888,983 | 6/1959 | Toti | 160/38 |
| 3,068,938 | 12/1962 | Hull | 160/176.1 |
| 3,224,490 | 12/1965 | Toti et al. | 160/168.1 |
| 3,574,887 | 4/1971 | Schindlauer | 160/19 X |
| 4,114,233 | 9/1978 | Hamilton | 160/38 X |
| 4,222,156 | 9/1980 | Anderle | 160/38 |
| 4,254,813 | 3/1981 | Vecchiarelli | 160/38 X |
| 4,384,604 | 5/1983 | Schaeffer et al. | 160/38 |
| 4,662,421 | 5/1987 | Basmadji et al. | 160/38 |
| 4,719,955 | 1/1988 | Tachikawa et al. | 160/168.1 |
| 4,828,002 | 5/1989 | Ashby | 160/38 |
| 4,840,216 | 6/1989 | John | 160/38 X |

*Primary Examiner*—David M. Purol

*Attorney, Agent, or Firm*—Vernon J. Pillote

[57] ABSTRACT

A valance for concealing window blind headers or drapery fixtures. The valance includes a front panel and end panels, and each of the panels have an upper rail adjacent the upper edge defining a downwardly projecting lip, a lower rail adjacent the lower edge defining an upwardly projecting lower lip, and an intermediate rail defining an upwardly projecting intermediate lip and a downwardly projecting intermediate lip. Upper and lower valance face members are provided for each panel and each face member has a front wall, a reentrant channel extending lengthwise along one rear edge and an internal hook portion spaced inwardly from a second rear edge. The reentrant channels on the upper and lower valance face members are arranged to receive the respective upper and lower intermediate lips and the internal hook portions on the upper and lower face members are respectively arranged to receive the upper and lower lips on the associated panel. Corner members are provided to extend between the ends of the valance face members on the front and end panels.

18 Claims, 2 Drawing Sheets

12
12a
12b
12c
12d
13
11
11a
11b
10
10a
21
21a
22
22a
22b
23
23a
23'
11'
11a'
11b'
10'
10a'
15a
15b
15a'
15b'
16a
16b
25
26
27
28
29
30
31
31'
2
3

Fig. 2.
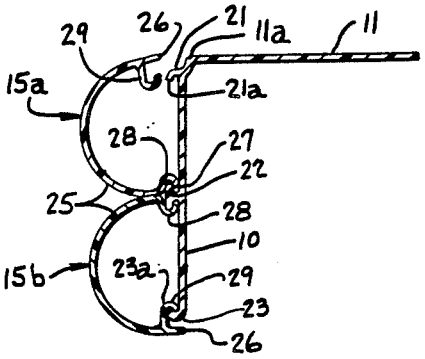
Fig. 3.
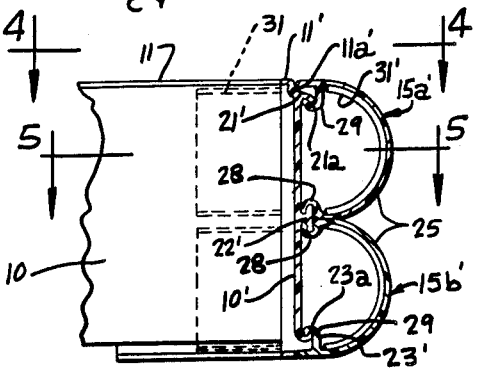
Fig. 4.
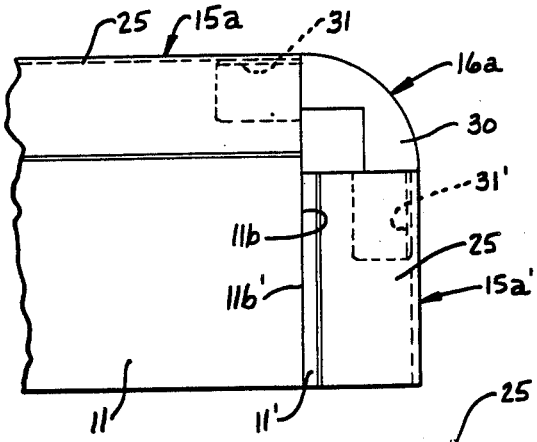
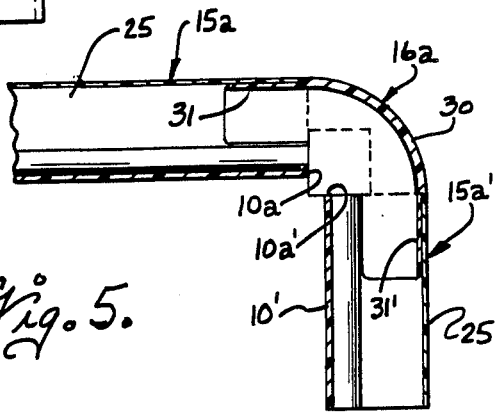
Fig. 5.

DECORATIVE VALANCE

BACKGROUND OF INVENTION

Various valances have heretofore been made for concealing vertical or horizontal blind headers and drapery rods, in which one or more decorative face members are removably attached to the valance to enable changing the decorative appearance of the valance. In many prior valance constructions having removable face members, portions of the valance base or valance mounting brackets remained exposed to view when the decorative face members were installed, and this adversely affected the overall appearance of the valance. Some valances with removable decorative face members were difficult to assemble because they required sliding of the long decorative face members into grooves or recesses in the valance base or valance brackets. Further, in some prior decorative valance constructions, the decorative face members could not be attached or removed from the valance after the valance was installed adjacent a ceiling or other overhead.

SUMMARY OF THE INVENTION

It is an object of the present invention to overcome the disadvantages of the prior art valances with removable decorative face members by providing a valance having an improved construction for detachably mounting the decorative face members on the face of the valance panel, and which allows the decorative inserts to be attached from the front of the face panel and which does not require endwise sliding of the decorative face members; in which the decorative inserts effectively conceal the front panel of the valance from view when the decorative face members are mounted; and in which the decorative face members can be readily attached and removed from the valance even when the valance is installed adjacent the ceiling or other overhead.

BRIEF DESCRIPTION OF THE DRAWINGS

FIG. 2 is a transverse sectional view taken on the plane 2—2 of FIG. 1 and illustrating mounting of a decorative member on the valance base;

FIG. 3 is a transverse sectional view taken on the plane 3—3 of FIG. 1;

FIG. 4 is a fragmentary plan view taken on a plane 4—4 of FIG. 3; and FIG. 5 is a fragmentary horizontal sectional view taken on the plane 5—5 of FIG. 3.

Figure 1:
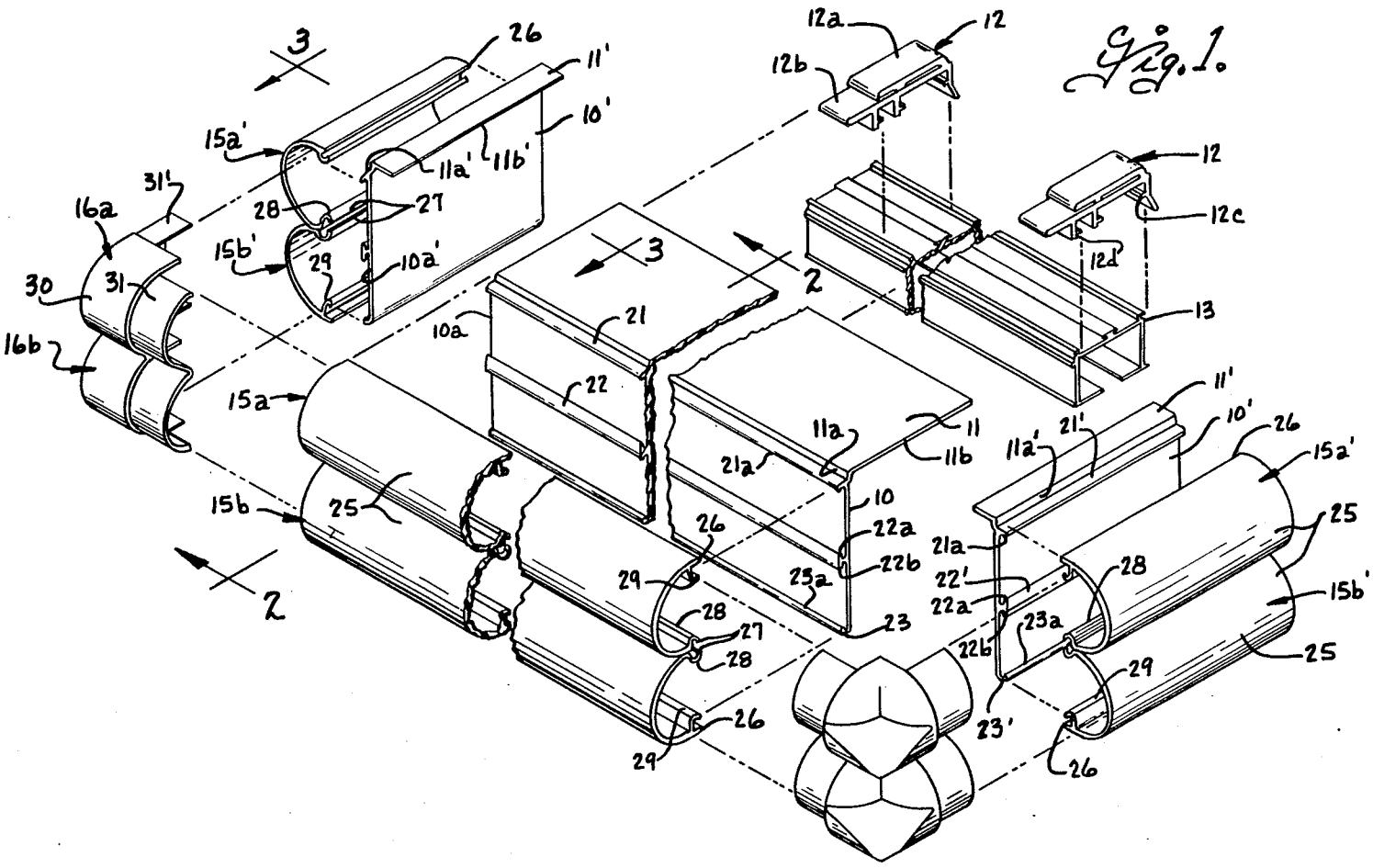
FIG. 1 is an exploded perspective view of a valance embodying the present invention.

The decorative valance is generally adapted for use to conceal the headers of a vertical or horizontal venetian blind or a drapery rod or curtain rod fixture. The valance includes a valance base having a front panel 10 and a top panel 11 extending rearwardly from adjacent the upper edge of the front panel. In the preferred embodiment shown, the valance also includes end panels 10' having a top wall portion 11' extending laterally from adjacent the upper edge of the end panel. Any suitable mounting means may be provided for mounting the valance adjacent a window opening and, as shown in FIG. 1, the valance is conveniently mounted on brackets 12 attached to the header 13 of a venetian blind or other drapery fixture. The bracket 12 has upper and lower wall portions **12*a* and 12*b* adapted to receive a rear edge portion of the top panel 11 of the valance base to support the valance thereon. The bracket 12 also has hook portions 12*c* and 12*d* to engage rails on the header 13 to mount the bracket on the header. As is conventional, header mounting brackets (not shown) are used to mount the header 13** either on a wall or a window casing or on the ceiling.

Upper and lower decorative valance face members **15*a* and 15*b* are adapted to be detachably mounted on the front panel 10 of the header, and decorative valance face members 15*a'* and 15*b'* of similar cross-sectional configuration, are adapted to be detachably mounted on the end panels 10'. For this purpose, an upper rail 21, an intermediate rail 22 and a lower rail 23 are formed integrally with the front panel 10 and similar upper, lower, intermediate rails 21', 22' and 23' are provided on the end panels 10'. The upper rails 21 and 21' each define a downwardly projecting upper lip 21*a* extending lengthwise of the upper edge of the associated panel. The lower rails 23 and 23' each define an upwardly projecting lower lip 23*a* extending along the lower edge of the associated panels 10, 10'. The intermediate rails 22 and 22' each define an upwardly extending lip 22*a* spaced a preselected distance below the upper lip 21*a* on the associated panel, and a downwardly projecting lip 22*b* spaced a preselected distance above the lower lip 23*a*** on the associated panel.

The upper and lower valance face members **15*a*, 15*b* and 15*a'*, 15*b'*, are advantageously of like cross-sectional configuration. The decorative face members each include a front all 25, herein shown of generally C-shaped cross-sectional configuration, and having a first and second rear edges 27 and 26. The valance face members are each formed with a reentrant channel 28 inwardly of the rear edge 27, and a lengthwise extending hook portion 29 disposed internally of the front wall and inwardly of the second rear edge 26. The reentrant channel 28 on each upper valance face member 15*a*, 15*a'* is adapted to receive the upwardly projecting intermediate lip 22*a* on the associated panel, and the internal hook portion 29 on each upper valance face member is adapted to receive the downwardly projecting upper lip 21*a* on the associated panel. Similarly, the reentrant channel 28 along the rear edge 27 of each lower valance face member 15*b* is adapted to receive the downwardly projecting lip 22*b* on the associated panel and the hook portion 29 on each lower valance face member 15*b* is adapted to receive the upwardly projecting lower lip 23*a* on the lower edge of the associated panel. As best shown in FIGS. 2 and 3, the lower valance face members 15*b*, 15*b'* have a portion that extends rearwardly from the associated hook portion 29 below the lower edge of the associated panel to effectively conceal the lower rail and the lower edge of the panel from view when the valance is viewed from a position below and in front of the valance. Similarly, the upper valance face members 15*a*, 15*a'* have a portion that extends rearwardly from the hook portion 29 and which is adapted to overlie the upper edge of the upper rails 21*a*, 21*a'* of the associated valance panel 10, 10'. The decorative face members are formed of a resilient deformable material such as PVC plastic and are constructed and arranged so that they are resiliently compressible to allow the hook portion 29 on the upper and lower valance face members to snap over the respective upper lip 21*a* and lower lip 23*a* on the associated panels. As best shown in FIGS. 2 and 3, the hook portions 29 of the decorative valance members are spaced inwardly from the rear edge 26 a distance sufficient to allow the hook portions to snap over the upper and lower lips 21***a* and 23*a*. The reentrant channels 28 on the valance face members receive the upper lip 22*a* and lower lip 22*b* on the intermediate rail and are arranged so as to extend contiguous to each other as shown in the drawings, when they are mounted on the front panel 10 and end panel 10'. The upper and lower valance face members can be colored, coated or covered to provide a desired decorative finish. When installed the valance face members effectively conceal from view the front panel and the rails 21, 22, 23 thereon and the upper and lower edges of the front panel 10. The top panels 11, 11' are advantageously joined to the associated front panel 10 and end panel 10' by an offset portion designated 11*a*, 11*a'* and such that the upper rear edges 26 of the upper valance face members 15*a*, 15*a'* are disposed generally coplanar with the associated top panel 11, 11' when the valance face members are installed.

The valance is advantageously constructed so that the valance face members 15*a*, 15*b* and 15*a'*, 15*b'* can be cut or formed coextensive in length with the associated panel 10, 10'. The valance face members 15*a*, 15*b* on the front and the end panels 10, 10' have adjacent ends disposed in relatively transverse planes and the corner members 16*a* and 16*b* are arranged to extend between the adjacent ends of the valance face members. The corner members 16*a*, 16*b* are of like construction and each include an intermediate portion 30 and end portions 31 and 31' extending from the intermediate portion and adapted to be telescopically received in the ends of the valance face members on the front and end panels respectively. The portions 31, 31' of the corner members 16*a*, 16*b* extend closely adjacent the inner wall of the associated valance face member and have edge portions that extend alongside the reentrant channel 28 and hook portions 29, as best shown in FIGS. 3 and 5. The intermediate portion 30 of the corner members are preferably formed with an external configuration that merges and blends with the external configuration of the associated valance face members 15*a*, 15*b* and 15*a'*, 15*b'* so as to form a smooth transition therewith. As will be seen from FIG. 5, the front and end panels 10 and 10' have ends 10*a* and 10*a'* that are spaced from each other and the corner members 16*a*, 16*b* abut against the ends of the panels 10 and 10'. The top panel 11' on the end panel 10' is dimensioned so that its edge 11*b'* abuts against the end 11*b* of the top panel 11. In the embodiment disclosed, the corner members 16*a*, 16*b* are supported by the valance face members 15*a*, 15*b* on the front panel 10, and the corner members 16*a*, 16*b* with end panels 10' support the valance face members 15*a'*, 15*b'*.

From the foregoing it is believed that the construction and installation of the valance system will be readily understood. The valance face members can be cut or formed to the same length as the associated front and end panels and the valance face members can be snapped in place on the associated panel and do not require slidable insertion from the ends of the panels. The corner members 16*a*, 16*b* are mounted by inserting the telescoping end portions 31, 31' into the ends of the associated valance face members and the corner members complete the corner between the ends of the valance face members. When installed, the valance face members conceal the associated panel in the rails thereon.

The embodiments of the invention in which an exclusive property or privilege is claimed are defined as follows:

1. A valance for concealing a window blind header or drapery fixture comprising, an elongated panel having a front face and lengthwise extending upper and lower edges, means for mounting the valance with the front face of the panel in a generally upright plane, upper rail means on the front face of the panel adjacent the upper edge defining a downwardly projecting upper lip, a lower rail means on the front face of the panel adjacent the lower edge defining an upwardly projecting lower lip, intermediate rail means on the front face intermediate the upper and lower edges defining an upwardly projecting intermediate lip spaced below the upper lip and a downwardly projecting intermediate lip spaced above the lower lip, upper and lower valance face members each having a front wall and first and second rear edges, each face member having means defining a reentrant channel extending lengthwise along the first rear edge and means defining a lengthwise extending hook portion disposed internally of the front wall adjacent the second rear edge, the reentrant channel on the upper valance face member being adapted to receive the upwardly projecting intermediate lip and the internal hook portion on the upper valance face member being adapted to receive the downwardly projecting upper lip, the reentrant channel on the lower valance face member being adapted to receive the downwardly projecting intermediate lip and the internal hook portion on the lower valance face member being adapted to receive the lower upwardly projecting lip of the panel.

2. A valence according to claim 1 wherein the lower valance face member has a portion extending rearwardly from the internal hook portion to underlie the lower edge of the panel.

3. A valance face member according to claim 1 wherein the lower valance face member has a portion extending rearwardly from the internal hook portion to underlie the lower edge of the panel, the upper valance face member having a portion extending rearwardly from the internal hook portion to overlie the upper edge of the panel.

4. A valance according to claim 1 wherein the front walls of the upper and lower valance face members extend contiguous to each other at a location in front of the intermediate rail means on the panel.

5. A valance according to claim 1 wherein the valance includes a top panel integral with said front panel and extending rearwardly therefrom.

6. A valance according to claim 1 wherein the upper and lower valance face members have the same cross-sectional configuration.

7. A valance for concealing window blind headers or drapery fixtures comprising an elongated front panel having an outer face and lengthwise extending upper and lower edges and ends, means for mounting the valance with the front face in a general upright plane, first and second end panels each having an outer face and upper and lower edges and ends, upper rail means on the outer face of each of the panels adjacent the upper edge thereof defining a downwardly projecting upper lip, lower rail means on the front face of each of the panels adjacent the lower edges thereof defining an upwardly projecting lower lip, intermediate rail means on the front face of each of the panels defining an upwardly projecting intermediate lip spaced below the upper lip and downwardly projecting intermediate lip spaced above the lower lip, upper and lower valance face members for each panel, each valance face member having a front wall and first and second rear edges, each valance face member having means defining a reentrant channel extending lengthwise along the first rear edge and means defining a lengthwise extending hook portion disposed internally of the front wall adjacent the second rear edge, the reentrant channel on each upper valance face member being adapted to receive the upwardly projecting intermediate lip on the associated panel and the internal hook portion on each upper valance face member being adapted to receive the downwardly projecting upper lip on the associated panel, the reentrant channel on each lower valance face member being adapted to receive the downwardly projecting intermediate lip on the associated panel, and the internal hook portion on each lower valance face member being adapted to receive the upwardly projecting lower lip on the associated panel.

8. A valance according to claim 7 including corner members extending between the valance face members on the front panel and the valance face members on the first and second end panels.

9. A valance according to claim 7 wherein the valance face members on the front panel and the first and second end panels have adjacent ends disposed in relatively transverse planes, and including corner members having an intermediate portion with an external configuration shaped to merge smoothly with the valance face members on the front and end panels and end portions extending from the intermediate portion and adapted to be telescopically received in the ends of the valance face members on the front and end panels.

10. A valance according to claim 9 wherein the first and second end panels and the valance face members thereon are supported by the corner members.

11. A valance according to claim 7 wherein each lower valance face member has a portion extending rearwardly from the internal hook portion to underlie the lower edge of the associated panel.

12. A valance according to claim 7 wherein each lower valance face member has a portion extending rearwardly from the internal hook portion to underlie the lower edge of the associated panel, each upper valance face member having a portion extending rearwardly from the internal hook portion to overlie the upper edge of the panel.

13. A valance according to claim 7 wherein the front walls of the upper and lower valance face members extend contiguous to each other at a location in front of the intermediate rail on the associated panel.

14. A valance according to claim 7 wherein the valance includes a top panel integral with the front panel and extending rearwardly therefrom.

15. A valance according to claim 7 wherein each of the upper and lower valance face members have the same cross-sectional configuration.

16. A valance according to claim 7 wherein the valance includes a top panel integral with the front panel and extending rearwardly therefrom, each upper valance face member having an upper rear edge portion extending rearwardly from the internal hook portion to overlie the upper edge of the associated panel, the upper rear edge portion of the upper valance face member on the front panel being disposed substantially coplanar with top panel.

17. A valance according to claim 16 wherein each lower valance face member has a lower rear edge portion extending rearwardly from the internal hook portion to underlie the lower edge of the associated panel.

18. A valance according to claim 17 wherein the upper and lower valance face members have the same cross-sectional configuration.

* * * * *